US005669988A

United States Patent [19]

Takenaka et al.

[11] Patent Number: 5,669,988

[45] Date of Patent: Sep. 23, 1997

[54] CORRUGATING ROLL AND MANUFACTURING METHOD THEREOF

[75] Inventors: Hiroyuki Takenaka; Yorishige Tosaka; Yasunobu Sahara, all of Mihara; Yoshiaki Maruyama; Hidenori Yamane, both of Hiroshima; Akio Izuwa, Mihara, all of Japan

[73] Assignee: Mitsubishi Jukogyo Kabushiki Kaisha, Japan

[21] Appl. No.: 513,082

[22] Filed: Aug. 9, 1995

[30] Foreign Application Priority Data

Aug. 12, 1994 [JP] Japan ..... 6-190491

[51] Int. Cl.[6] ..... C23C 8/26; C23C 8/32

[52] U.S. Cl. ..... 148/210; 148/212; 148/218; 148/220; 148/232

[58] Field of Search ..... 148/210, 212, 148/217, 218, 220, 232, 233, 238

[56] References Cited

U.S. PATENT DOCUMENTS

| | | | |
|---|---|---|---|
| 3,397,092 | 8/1968 | Cavanagh | 148/217 |
| 4,154,565 | 5/1979 | Hyde et al. | 425/369 |
| 4,765,847 | 8/1988 | Arai et al. | 148/217 |

FOREIGN PATENT DOCUMENTS

| | | | |
|---|---|---|---|
| 2000320 | 4/1990 | Canada | 148/220 |
| 320706 | 6/1989 | European Pat. Off. . | |
| 2031373 | 11/1970 | France . | |
| 2460340 | 1/1981 | France | 148/220 |
| 3939809 | 6/1991 | Germany . | |

OTHER PUBLICATIONS

*Patent Abstracts of Japan*, vol. 14, No. 254 (C–0724), May 31, 1990 (JP 2–070074).

Zaitsev et al., "Formation of Coatings on Bearing Steel ShKh15 During Ion–Plasma Nitriding and Subsequent Quenching with Tempering," *Metal Science and Heat Treatment*, 32(Sep. 10):650–655, Sep. 1990.

Bergmann et al., "Kombination des Laserstrahlhärtens mit einer Kurzzeitnitrierbehandlung," *Harterei–Technische Mitteilungen*, 48(4):238–248, Jul. 1993.

*Primary Examiner*—George Wyszomierski

*Attorney, Agent, or Firm*—Rothwell, Figg, Ernst & Kurz, P.C.

[57] ABSTRACT

Object: Prevention of generation of press marks as well as increase of wear resistance at a corrugation tip portion and thereby providing a corrugating roll having a much improved life.

Construction: A manufacturing method of a corrugating roll useful for forming a wave-shaped core paper of corrugated board, characterized in that the corrugating roll is worked to form tooth-shaped corrugation portions on the outer circumference and applying a nitriding treatment or a carbonitriding treatment, and then applying to the corrugation portion of the corrugating roll a quenching and tempering treatment, and further forming a wear resistant coating on the surface of the corrugation portion.

13 Claims, 5 Drawing Sheets

CORRUGATING ROLL AND MANUFACTURING METHOD THEREOF

BACKGROUND OF THE INVENTION

1. Field of the Invention

The present invention relates to a corrugating roll used in a single facer which is a device for manufacturing corrugated boards and relates to a manufacturing method of the corrugating roll.

2. Description of the Prior Art

A single facer is generally constructed as shown in a schematic cross sectional view of FIG. 3. In this figure, each component is designated by a numeral respectively as follows: 1: an upper corrugating roll, 2: a lower corrugating roll, 3: a pressure roll, 4: a glue application roll, 5: a metering roll, 6: a glue container, 7: a core paper, 8: a liner paper, 9: single faced corrugated board.

At first, a manufacturing process of a single faced corrugated board 9 by use of a single facer is described. A core paper 7 fed onto the upper corrugating roll 1 is bitten into an engagement portion of the upper corrugating roll 1 and the lower corrugating roll 2 to form a wave-shaped sheet. Then, while the core paper 7 is transferred by rotation of the lower corrugating roll 2, a glue material contained in a glue container 6 is dripped up by a glue application roll 4, adjusted of glue film by a metering roll 5 and put onto corrugation tip portions of the core paper 7 by the glue application roll 4. On the other hand, a liner paper 8 and the glued core paper 7 supplied to a pressure roll 3 are bonded together at a pressure portion of the lower corrugating roll 2 and the pressure roll 3 to form a single faced corrugated board 9.

Base metal of the corrugating roll 1, 2 is normally an ordinary steel or an alloy steel, and tooth portion thereof is applied by an induction hardening and then applied by an engineering chromium plating of 50 to 100 μm thickness, etc. for improvement of a wear resistance and a settling resistance. The reason therefor is that since, in the above-mentioned wave-shape forming process of the core paper 7, or more specifically as shown by an enlarged cross sectional view of the engagement portion of the corrugating rolls 1, 2 in FIG. 2, the core paper 7 is pulled into the engagement portion of the corrugating rolls 1, 2 with slippage on the corrugation tip portion, a wear resistant nature of the corrugation tip portion is required, and in order to minimize a deflection of the corrugation tip portion due to biting of foreign matters, a settling resistant nature is also required.

If the corrugating roll, despite various work processes being so applied, has a concave portion, or a press mark, on the corrugation tip portion, it is deemed defective, so when it is applied by a re-plating after the chromium plated layer is worn to its life, the corrugation portion is grinded for removing the concave portion. As a result, the diameter of the corrugating roll naturally becomes reduced by at least twice the concave amount. While the height of the corrugation portion is required to be a certain level for strength of the corrugated board, etc., the root diameter is likewise reduced. This means that, although the number of the corrugation portions of the corrugating roll is constant, circumferential length thereof becomes shorter, thus the amount of the core paper used per unit length of the liner paper becomes larger. As this results in increase of the cost of corrugated board sheets, the corrugating roll is re-grinded and re-plated two or three times for use and thereupon the entire roll is abandoned. Such concave portions generated at the corrugation tip portion lead to such an important loss as abandonment of the corrugating roll, and if generation of the concave portion caused by biting of foreign matters during operation is prevented, then the effect thereof is extremely high.

The circle marks shown in the graph of FIG. 1 show a correlation between the hardness (Shore hardness Hs) of the corrugation tip portion of an actual corrugating roll which has come to its life and the number of the concave portions (observed by eyes), which shows that generation of many concave portions is seen in the range of lower hardness and that if the hardness is made Hs 80 or more, then there occurs almost no such concave portions, or press marks, as shown by the envelope line of same figure.

The above is a case where a chromium plating is applied for increase of a wear resistance. In case of a chromium plating, not only a toughness of coating but also an adhesiveness thereof are high and then a peeling of the coating does not occur even in a case of a concave portion being generated. Further, with respect to the coating of high hardness of Hv (Vickers hardness) 1000 or more which is higher than that of a chromium plated coating, there is an attempt to remarkably increase a wear resistance of the corrugating roll by use of a coating, such as a diamond coating, a TiC coating, a SiC dispersion Ni—P plated coating, etc. But in the present situation, these coatings are still apt to cause a peeling of coating due to generation of press marks and are difficult to be applied to the conventional base metals of a corrugating roll. At present, there is a method to apply a WC—Co thermal spraying coating of hardness of Hv approximately 1150 as a practical attempt to apply to a corrugating roll. But, in this method, while the amount of wearing tends to be remarkably lowered, a peeling easily occurs at the press mark portion for reason of a low hardness of the base metal of the corrugating roll, thus the quality of corrugated boards is degraded and a desired life prolongation of the roll is not so much attained yet.

As shown in FIG. 1, a method to prevent generation of concave portions is to make the hardness of the corrugation portion Hs 80 or more. The raw material of the corrugating roll is presently made of a chromium-molybdenum steel, etc., but in order to obtain a hardness of Hs 80 or more by way of a treatment of a quench hardening of steel, it is necessary to select a steel containing carbon of 0.40% or more ("Selection of Advanced Machine Materials" written by TAKASHI SOH, published by GIJUTSU HYOORONSHA, Mar. 1979, Page 211). As shown in FIG. 4, the corrugating roll comprises a shell 12 and a shaft 10, both combined by welding portions 11, and inside thereof, a hollow portion forms a pressure vessel to introduce therein a steam of 10 kgf/cm$^2$ G or more. For reason of a welding technology as well as due to legal regulations, use of a steel containing carbon of 0.35% or more is restrained. In other words, as far as a welding structure is used, realization of hardness of Hs 80 or more in a raw material is impossible. Then, in order to make the hardness of the corrugation portion Hs 80 or more, methods of treatment of the corrugation portion, such as a carburizing and quenching, a nitriding or cladding of high carbon steel or high alloy steel and heat treatment, etc. are considered. But in the case of a carburizing and quenching method, if the temperature of treatment is increased, e.g. to about 930° C., a treatment distortion becomes large and the thickness of the carburized and quenched layer becomes non-uniform after a finish work is carried out thereon. Further, in the case of a cladding method, a cladding of uniform thickness is difficult. If a corrugating roll manufactured by a treatment at such a high temperature as mentioned above is heated to about 180° C.

which is a temperature of actual use, the contact pressure between the upper and the lower corrugating rolls or with a pressure roll becomes non-uniform due to a thermal distortion caused by a non-uniformity of thermal expansion in the circumferential direction, and defects in the forming or bonding are worried about to occur. Further, a non-uniformity of thickness of a carburized layer or a cladded layer makes a circumferential distribution of residual stress non-uniform, and as a result, vibrations at an actual operation or releases of residual stress by heating cycles cause a bending distortion of the corrugating roll and makes the problem larger together with the thermal distortion mentioned above.

As the corrugating roll is required to make such uniform contacts between the rolls, a forming of extremely uniform hardened layers in the circumferential direction is necessitated in the above-mentioned surface hardening treatments, and for this purpose, it is necessary to select a surface treatment method in which a treatment distortion is small. An effective method to make the treatment distortion smaller is to make the treatment temperature lower, one method for which is a nitriding method as mentioned above. In this method, while the treatment temperature is 550° C. to 600° C. which is lower than that of the carburizing method in which a high temperature treatment is performed, and the treatment distortion can be sharply reduced, as the depth of hardening by nitriding is as small as 0.2 mm to 0.3 mm and the nitriding layer might be removed by a finishing work so that the effect of nitriding is lost, a desired performance cannot be obtained by use of a single treatment method. This means that by a single treatment of a heretofore known nitriding or carburizing, a hardening characteristic as desired for a corrugating roll cannot be obtained.

Accordingly, the heretofore known methods are of a nature of antinomy in a meaning that a treatment method in which an enough hardening depth is obtained is not good in a measurement stability so as not to be usable, while a treatment method in which a treatment distortion is small and satisfactory in a measurement stability is not enough in a hardening depth so as not to be usable.

Thus, in order to realize a corrugating roll in which concave portions are not generated during operation, it is necessary to make clear what is a hardening depth necessary for prevention of concave portions and further to realize what is a surface hardening method by which such a hardening depth is satisfied with a small treatment distortion.

Further, as mentioned above, as a coating having a higher hardness than that of a chromium plated coating is inferior in a toughness and a coating having such a hardness as causes press marks due to a low adhesiveness with a base metal causes a peeling, such coatings are hardly applicable to a corrugating roll and there is a current necessity to develop a corrugating roll which does not cause a generation of press marks, which is also necessary in order to increase a wear resistance more than that of a chromium plated coating.

SUMMARY OF THE INVENTION

In view of the above-described problems inherent in the prior art, it is an object of the present invention to provide a corrugating roll which prevents generation of press marks at a corrugation tip portion and increases a wear resistance so that a life of the roll is remarkably improved.

The present invention which is developed for attaining said objectives relates to (1) a manufacturing method of a corrugating roll to form a wave-shaped core paper of corrugated board, characterized in that the corrugating roll is worked to form tooth-shaped corrugation portions on the outer circumference and applied by a nitriding treatment or a carbo-nitriding treatment and then the corrugation portion of the corrugating roll is applied by a quenching and tempering treatment and further a wear resistant coating is formed on the surface of the corrugation portion, and (2) a corrugating roll comprising tooth-shaped corrugation portions on the outer circumference, characterized in that a base metal of the corrugation portion of the corrugating roll is applied by a nitriding treatment or a carbo-nitriding treatment and then applied by a quench hardening, and a high hardness outer layer of a thickness of 0.6 mm or more and of a Shore hardness (Hs) of 80 or more is formed along the profile of the corrugation tip portion or the corrugation portion.

More specifically, a base metal of the corrugating roll is taken from a normal steel as heretofore used (structural carbon steel S43C, C=0.30–0.38%) or an alloy steel (chromium-molybdenum steel SCM440, C=0.38–0.43%), etc. If there is a problem of strength, for increase of hardness by way of a heat treatment, a carbon plus a nitrogen can well contribute thereto, and hence, the use of a material of high carbon content is advantageous for a nitriding treatment as it has less amount of nitriding penetration.

As for the nitriding treatment or the carbo-nitriding treatment, a gas nitriding method, an ionic nitriding method, an ionic carbo-nitriding method, a low temperature gas carbo-nitriding, a Tufftride method making a carbo-nitriding in a molten salt, etc. are named. These methods, being of low temperature treatments, have less treatment distortion, but as the thickness of hardened layer which satisfies hardness of Hs 80 or more is small, a local heating treatment only on the corrugation portion is carried out. That is, such a hardening method as is appropriate for a local heating (temperature at other portions being 200° C. to 300° C. or less) and gives less treatment distortion, e.g. an induction hardening, a laser hardening, a flame hardening (including flames of a gas flame, a plasma flame, an arc flame, etc.) is applied, and thereby the thickness of hardened layer can be sharply increased. FIG. 5 shows a graph of distributions of hardness at a cross section of a hardened layer when an ionic nitriding method and an induction hardening method are applied in combination. It is found therefrom that a quench hardening carried out subsequently to a nitriding treatment is important for forming a hardened layer of Hs 80 or more hardness with a desired thickness.

Incidentally, the increase of a hardened layer of Hs 80 or more by way of a quench hardening subsequent to a carburizing and nitriding is brought by an enhanced hardening ability by the increase of diffusion of solid solution carbon and nitrogen due to the carburizing and nitriding.

In order to obtain a hardened layer thickness of Hs 80 or more which is necessary for prevention of generation of concave portions, a single use of a nitriding treatment or a carbo-nitriding treatment requires extremely long time so that it is practically difficult to be applied, and thus according to the present invention, a combined heat treatment of a low temperature nitriding method or a carbo-nitriding method and a local heating treatment is carried out and a prevention of generation of concave portions is effectively attained. FIG. 6 shows a graph of a correlation between the hardened layer depth and the concave portion depth, which shows that in order to prevent generation of concave portions, a hardened layer of Hs 80 or more with a thickness of minimum 0.6 mm, preferably of 1.0 mm or more, is necessary, and in combination with FIG. 5, it is found that for this purpose, a combination of a nitriding method and a local heating treatment by an induction hardening is necessary.

Heat treatment of such raw materials as mentioned above is carried out, for example, on the following conditions:

| |
|---|
| Quenching, Tempering |
| 880° C. × 3 hours . . . OQ → 520° C. × 12 hours . . . AC |
| Induction hardening, |
| Tempering (after Ionic nitriding) |
| 850° C. immediately after |
| . . . AQ → 220° C. × 3 hours AC (in furnace) |

Further, a forming method of a wear resistant coating is generally made on the following conditions:

① Engineering chromium plating:

| |
|---|
| Plating bath: Sargent liquid; |
| Liquid temperature: 56° C. |
| Current density: 25–30 A/dm$^2$; |
| Work rotation in hanging method: 10 rpm |
| Plating time: 4 hours (100 μm thickness) |

② WC—Co thermal spraying:

| |
|---|
| Spraying process: JET HVOF (High Velocity Oxy-Fuel); |
| Spraying gun moving velocity: 120 mm/min |
| Work rotation: 25 rpm; |
| Spray material: WC-12Co Thermet |
| Particle diameter: 45–5 μm |

③ Q TiN coating:

After pre-heating to a temperature of 300° C. at an atmosphere of $10^{-4}$ Torr, a direct current voltage of 1 KV is turned on between a cruicible making Ti vapour deposition and a corrugation roll, and a coating is formed while the corrugating roll rotates at a vapour deposition velocity of about 1 μm/hr. Incidentally, prior to vapour deposition, a cleaning of coating surface is made by sputtering.

From FIG. 1, it is noted that if the hardness of the corrugation tip portion is Hs 80 or more, generation of concave portions can be prevented, and from FIG. 6, that if the depth of a hardened layer (Hs≧80) is minimum 0.6 mm, preferably 1.0 mm or more, it has a depression resistance of same degree as in the case where the hardened layer has an enough thickness. Thus, a hardened layer which is necessary for prevention of generation of concave portions is clarified, and thereby a possibility of realization of a treatment method such as a nitriding treatment, etc. which forms a hardened layer by a preferable low temperature treatment in order to reduce a treatment distortion, becomes clear. But, as shown in FIG. 5, a single use of a nitriding treatment being unable to realize formation of a hardened layer of a thickness exceeding 0.6 mm, a local hardening treatment such as an induction hardening, etc. is applied together and a necessary hardening depth can be attained.

While the minimum value of the necessary hardened layer depth for prevention of generation of concave portions is as mentioned above, the maximum value of a hardened layer depth is regulated by the ASTM standard for reason of safety of a pressure vessel (corrugating roll shell) and is made preferably less than 9.5 mm measured from a root of a corrugation portion (δ<9.5 mm). Incidentally, as concave portions are existing only on the corrugation tip portions in many cases, the minimum hardened layer depth is not necessarily secured at the entire range of the corrugation portion but a hardening only on the corrugation tip portion is enough, and even in the case of a laser hardening or a flame hardening where the heating is apt to gather on the corrugation tip portion so that the hardening is made only on the corrugation tip portion, it has practically no problem.

Further, as for a prevention of peeling of a coating having a hardness of more than that of a chromium plated coating, accompanying with the prevention of generation of press marks as resulted from FIG. 1 and FIG. 6, naturally a peeling also can be prevented, and an improvement of a life by wear can be attained effectively by the application of these hard coatings.

DESCRIPTION OF PREFERRED EMBODIMENTS

The present invention is more particularly described by preferred embodiments, provided that the present invention is not limited thereto:

(A first preferred embodiment)

Figure 1:
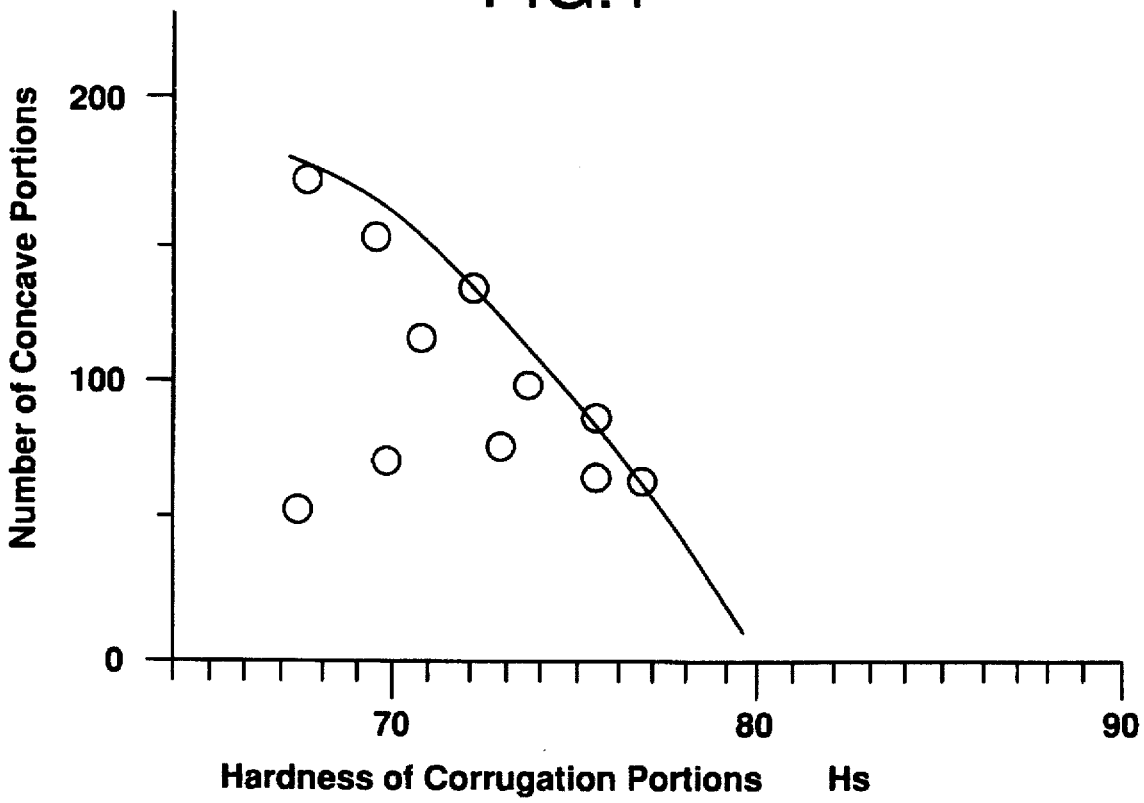
FIG. 1 is a graph showing a correlation between the hardness of corrugation portion and the number of concave portions and thereby showing a necessary hardness for prevention of concave portions which is a basis of the present invention.
Figure 2:
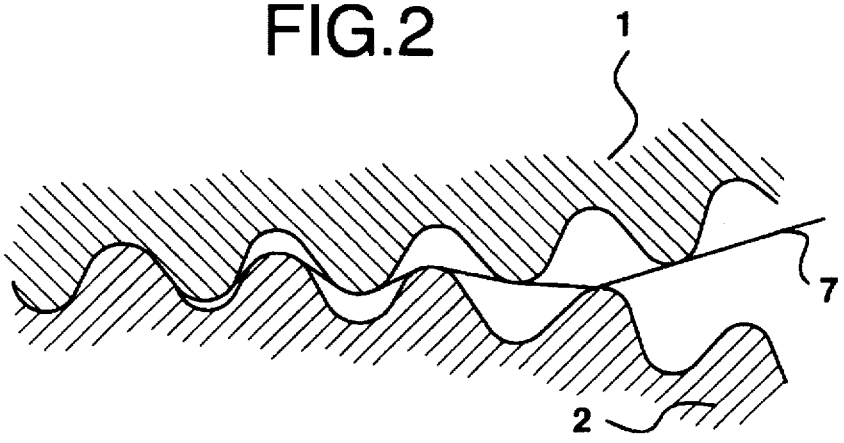
FIG. 2 is an enlarged cross sectional view showing a state of engagement of the corrugating rolls.
Figure 3:
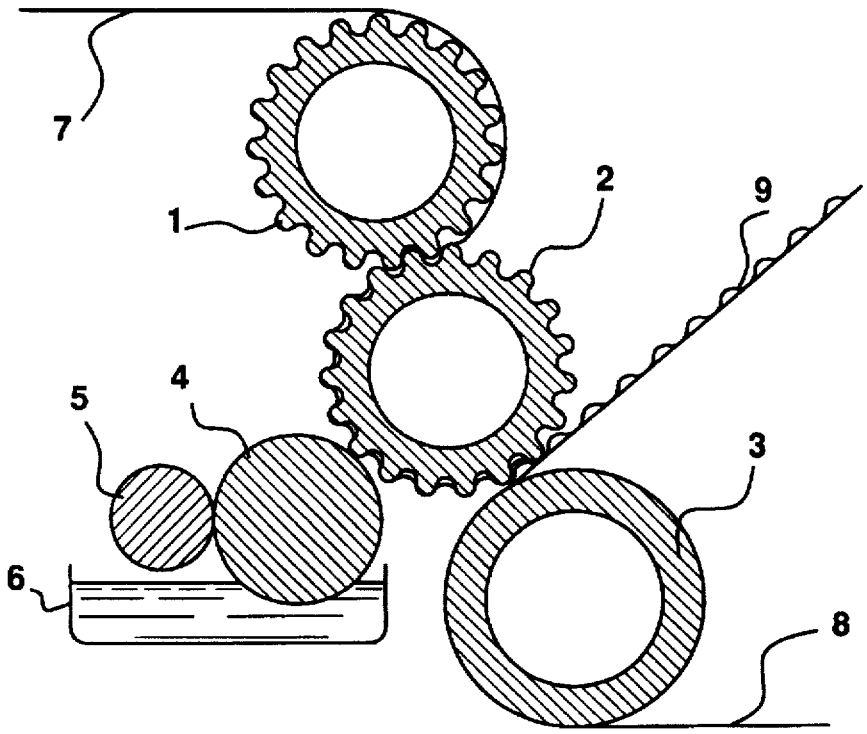
FIG. 3 is a schematic cross sectional view of a single facer.
Figure 4:
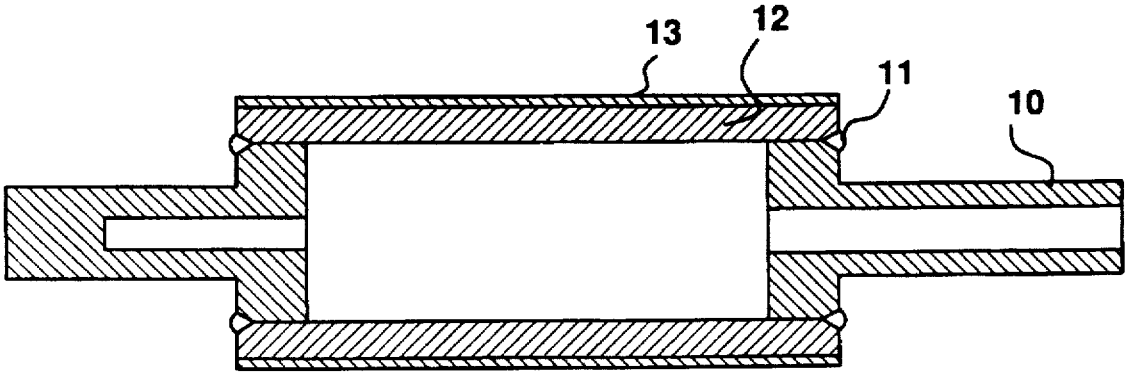
FIG. 4 is a cross section of a corrugating roll.
Figure 5:
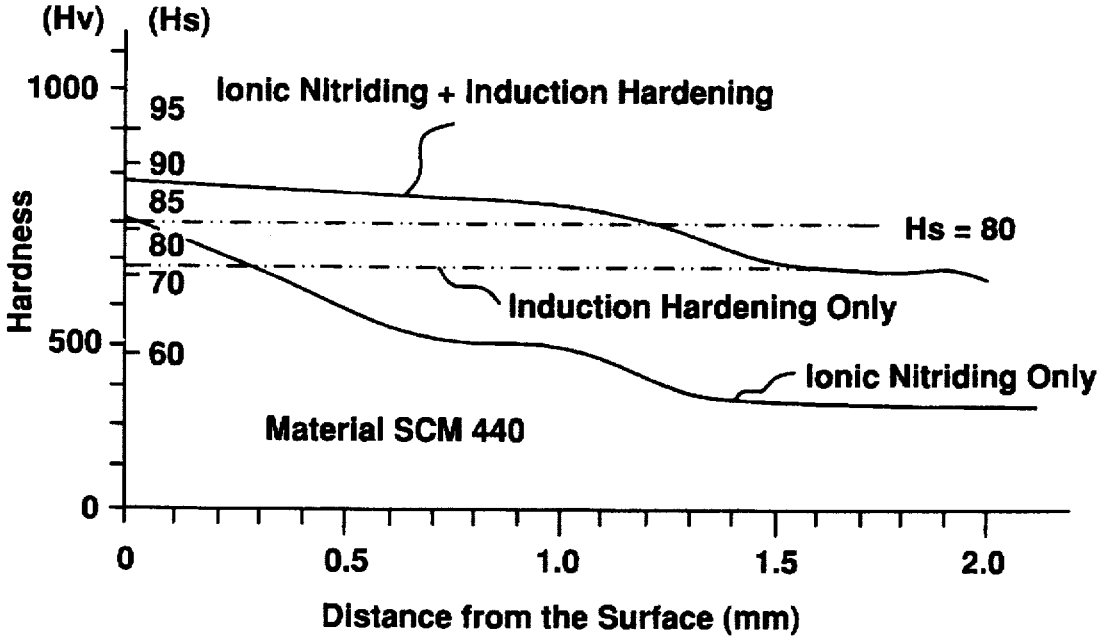
FIG. 5 is a graph showing hardness distributions on a hardened layer cross section when a combination of an ionic nitriding and an induction hardening is applied thereto.
Figure 6:
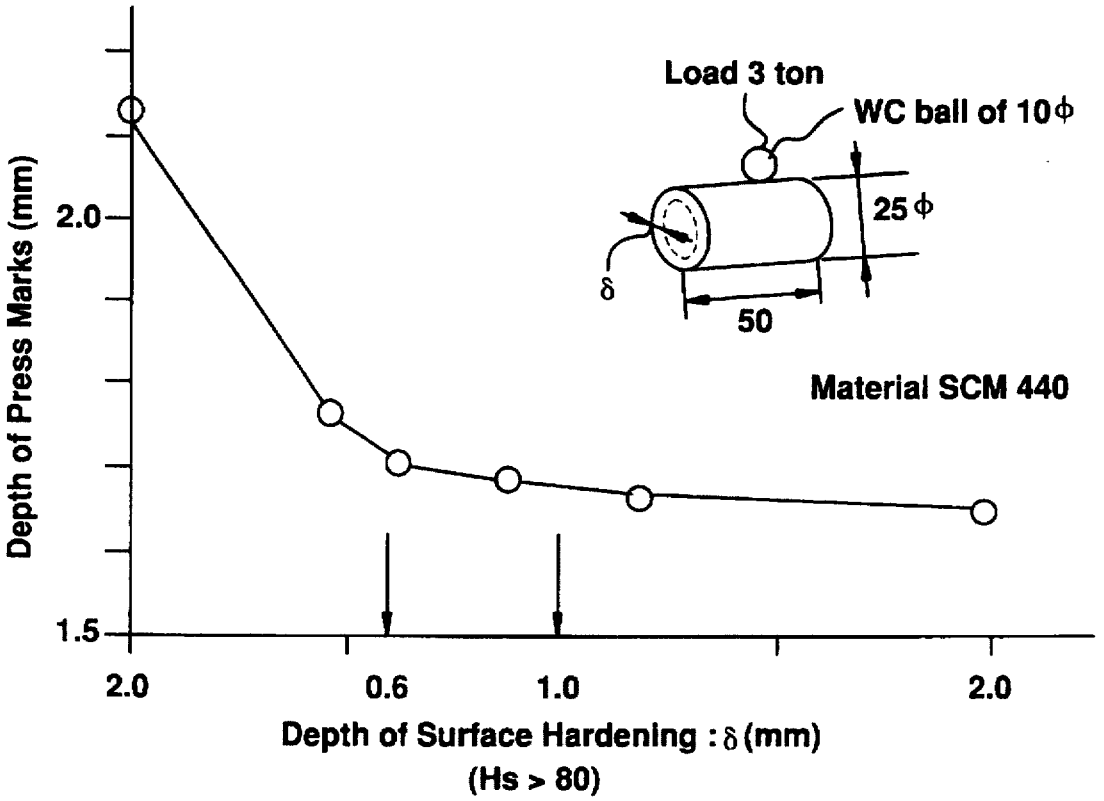
FIG. 6 is a graph showing a correlation between a hardened layer depth and a concave portion depth.
Figure 7:
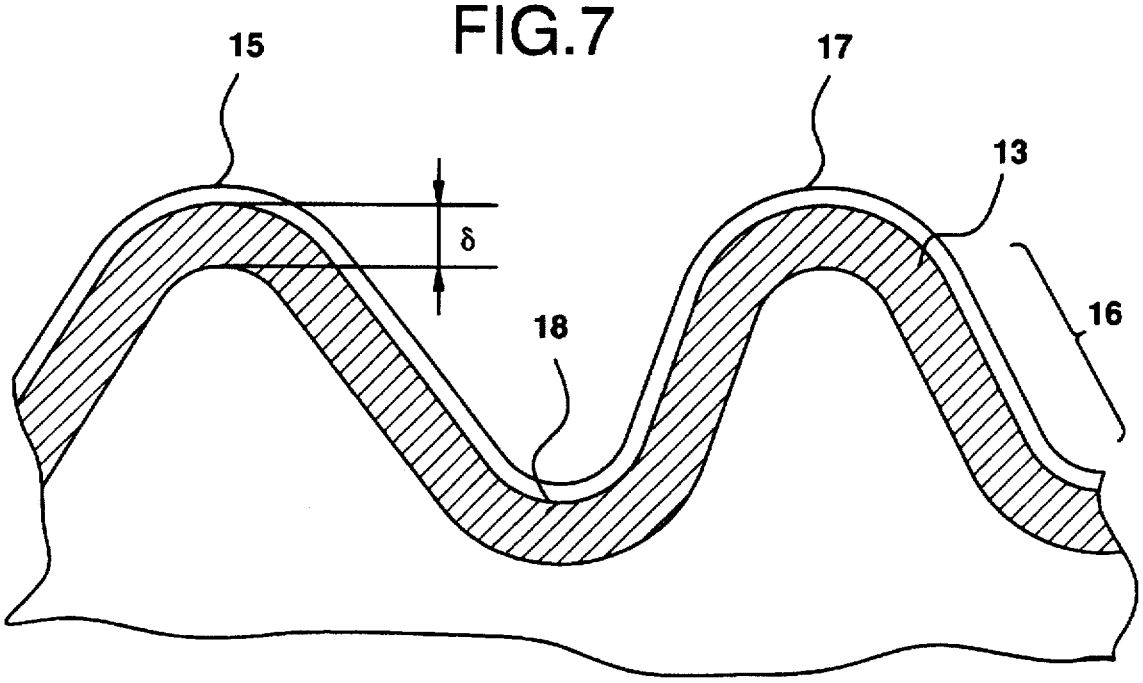
FIG. 7 is a cross section showing distributions of a hardened layer depth of a corrugating roll according to a first preferred embodiment.

FIG. 7 shows a cross section of corrugation portions of a corrugating roll in which the base metal SCM440 is first applied by an ionic nitriding and then by an induction hardening, wherein numeral 13 is a hardened layer of which hardness is Hs 80 or more and the treatment is made so as to secure the hardening depth δ of 0.6 mm or more. Subsequently, the outer circumferential portion of the corrugating roll is grinded and applied by an engineering chromium plating 15 (hardness Hv 950–1000) in a Sargent bath to a thickness of 100 μm. A corrugating roll produced for trial with such treatment is used for six months and the number of concave portions is observed, and it is confirmed that the number of concave portions is null.

(A second preferred embodiment)

Figure 8:
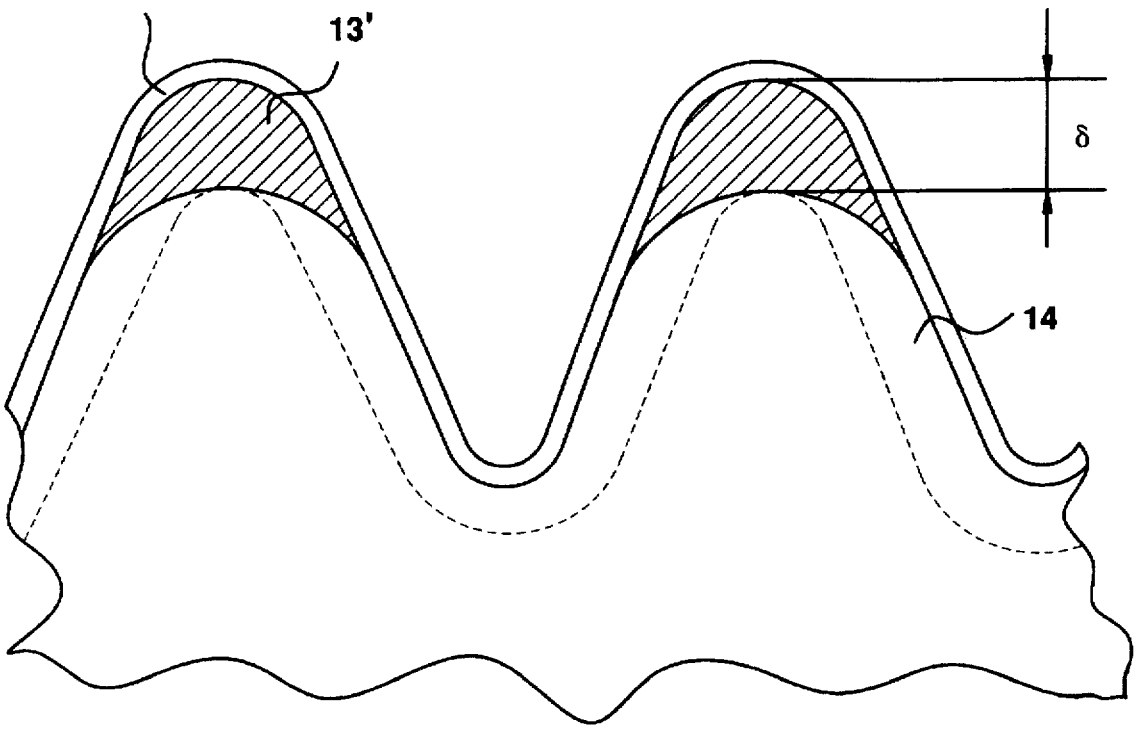
FIG. 8 is a cross section showing distributions of a hardened layer depth of a corrugating roll according to a second preferred embodiment.

FIG. 8 shows a cross section of corrugation portions of a corrugating roll in which the base metal SCM440 is first applied by an ionic nitriding and then by a $CO_2$ laser hardening in which a laser beam is irradiated with movement along the corrugation portion and then grinding and chromium plating are applied, and the hardened portions 13' are seen only on corrugation tip portions. Numeral 14 is a penetration layer of nitrogen with no quench hardening being applied thereto, and so the hardness is naturally low. Treatment is made so as to make the hardened layer depth δ 0.6 mm or more. A corrugating roll so trially produced is used for six months and for one year, then observation is made on the press marks on the surface. As a result, naturally on the corrugation tip portions, also on the non-hardened side surface of the corrugation portion and of the root portion, no press mark is seen, as expected.

(A third to an eleventh preferred embodiments)

TABLE 1

| Preferred embodiments No. | Material (JIS designation) | Carburizing and nitriding process | Treatment conditions | Quench hardening method | Hardened layer depth δ (mm) |
|---|---|---|---|---|---|
| 3 | SCM440 | Gas nitriding | $NH_3$ 570° C. × 100 Hr | Induction hardening | 1.0 or more |
| 4 | " | Ionic carbo-nitriding | $H_2$:$H_2$ = $X_2$ = 1:1:2 10 Torr 570° C. × 90 Hr | Induction hardening | 0.8 or more |
| 5 | " | Low temperature gas carbo nitriding | $NH_3$ R × gas 570° C. × 80 Hr | Induction hardening | 0.6 or more |
| 6 | " | Tufftride treatment | CN:8% CNO:30% 580° C. × 50 Hr | Induction hardening | 0.6 or more |
| 7 | S35C | Ionic nitriding | $N_2$:$H_2$ = 3:1 3 Torr 580° C. × 80 Hr | Induction hardening | 1.0 or more |
| 8 | SACM645 | Ionic carbo-nitriding | Same as the preferred embodiment No. 4 | Induction hardening | 0.6 or more |
| 9 | S35C | Ionic nitriding | Same as the preferred embodiment No. 7 | Flame hardening | 0.8 or more |
| 10 | SACM645 | Low temperature carbo-nitriding | Same as the preferred embodiment No. 5 | Laser hardening | 1.0 or more |
| 11 | S35C | Tufftride treatment | Same as the preferred embodiment No. 6 | Laser hardening | 0.3 or more |

In every case of the above, a good result is obtained.

(A twelfth preferred embodiment)

Figure 9:
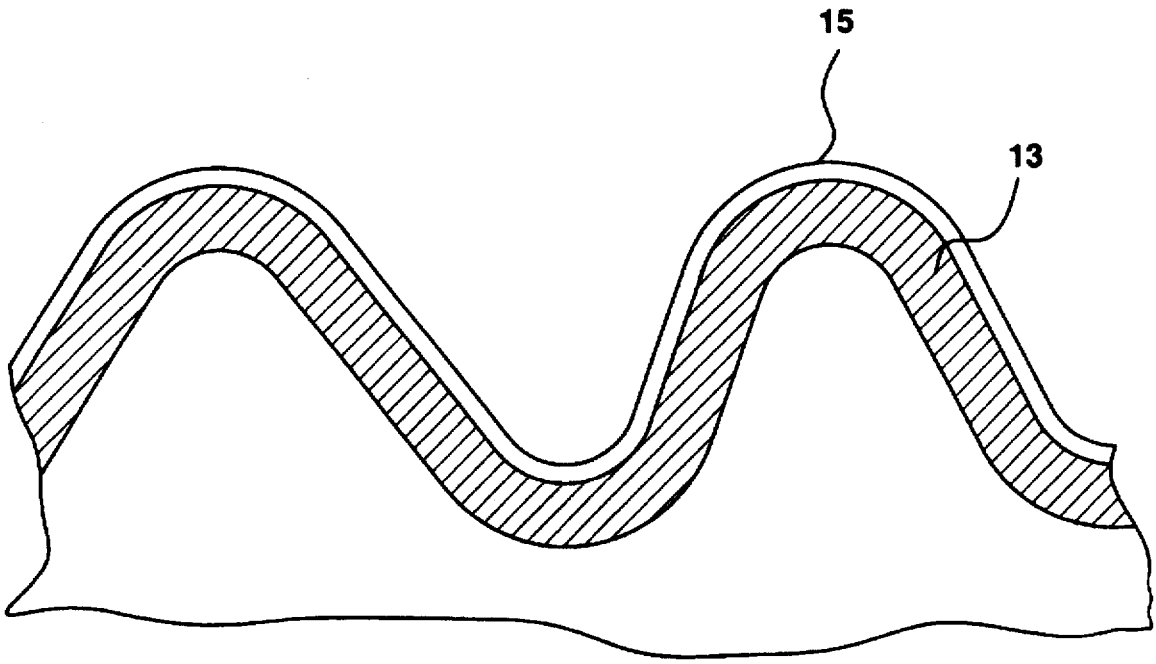
FIG. 9 is a cross section showing a state of a hardened layer of a corrugating roll and a wear resistant coating formed thereon according to a twelfth and a thirteenth preferred embodiments.

In the cases of the first to the twelfth preferred embodiments, chromium plated coatings 18 are used as a wear resistant coating applied on the hardened layer, but in this case of the twelfth preferred embodiment as shown in FIG. 9, a SiC dispersion Ni—P plated coating 15 (Hv 1250), in place of a chromium plated coating 15, is applied on the hardened layer of the first preferred embodiment. After this corrugating roll is actually used, there is seen no press mark generated during the use and thereby no peeling of the SiC dispersion Ni—P plated coating occurs, and the life by wear proves to be more than 100 μm thickness of a chromium plated coating.

(A thirteenth preferred embodiment)

In place of a chromium plated coating 15, a TiN coating 15 (5 μm) of hardness of Hv 1800 is applied on the hardened layer of the corrugating roll of the first preferred embodiment, as shown in FIG. 9.

As a result of use of this corrugating roll, needless to say of press marks, no peeling of the TiN coating is seen and the life by wear proves to be more than 100 μm thickness of a chromium plated coating.

Incidentally, a hardened layer having a higher hardness than that of a chromium plated coating is not limited to the mentioned examples but a diamond coating, a diamond like carbon coating, a diamond electrodeposition coating, a cBN coating, a TiC coating, a WC—Co thermal spraying coating, etc. are also applicable.

Further, the induction hardening, the flame hardening and the laser hardening in the above preferred embodiments are carried out with adjustment of the output of heating source and the moving velocity so as to maintain the temperature of the corrugation tip portion at about 850° C. and then an immediate water cooling is made. Subsequently, a tempering treatment is carried out at a temperature of about 200° C. for three hours.

With the corrugating roll according to the present invention, a generation of concave portions (press marks) at the corrugation tip portions as heretofore generated in the actual use is prevented, and as a result, such an excellent effect as mentioned below is expected:

① Regrinding process of the corrugation portion performed at the time of re-plating of a worn chromium plated layer becomes unnecessary or extremely shortened (cost reduction, shortening of construction period).

② Q Worsening of the take up ratio (increase of the cost of corrugated board sheets due to increase of the amount of use of core papers) is prevented.

③ Life of the roll is prolonged considerably.

④ High wear resistant coatings (e.g. a diamond coating, a TiC coating, a TiN coating, a SiC dispersion Ni—P plating, etc.), as have been non-applicable because of generation of press marks and peelings caused thereby, become applicable and a long life of use becomes possible.

What is claimed is:

1. A manufacturing method of a corrugating roll useful for forming a wave-shaped core paper of corrugated board, comprising the steps of:

a) forming tooth-shaped corrugation portions on the outer circumference of a corrugating roll; and b) forming a high hardness outer layer of a thickness of at least 0.6 mm and a Shore hardness (Hs) of at least 80 in the corrugation portions, said step b) including:

i) applying a nitriding treatment or a carbo-nitriding treatment to the corrugation portions;

ii) then applying a local heating quenching and tempering treatment to the corrugation portions; and c) then forming a corrosion resistant and wear resistant coating on the surface of the corrugation portion.

2. A manufacturing method of a corrugating roll according to claim 1, including applying the nitriding treatment by a gas nitriding method or an ionic nitriding method.

3. A manufacturing method of a corrugating roll according to claim 2, wherein the local heating quenching and tempering treatment includes induction hardening, laser hardening or flame hardening.

4. A manufacturing method of a corrugating roll according to claim 2, wherein the wear resistant coating is a hard chromium plating, a SiC dispersed Ni—P plating, a TiN coating, a TiC coating, a cBN coating, a diamond coating, a carbon coating, a diamond electroposited coating or a WC—Co thermal sprayed coating.

5. A manufacturing method of a corrugating roll according to claim 1, including applying the carbo-nitriding treatment by a gas carburizing and nitriding treatment method, an ionic carburizing and nitriding treatment method or a salt bath nitriding treatment method.

6. A manufacturing method of a corrugating roll according to claim 5, wherein the local heating quenching and tempering treatment includes induction hardening, laser hardening, or flame hardening.

7. A manufacturing method of a corrugating roll according to claim 5, wherein the wear resistant coating is a hard chromium plating, a SiC dispersed Ni—P plating, a TiN coating, a TiC coating, a cBN coating, a diamond coating, a carbon coating, a diamond electroposited coating or a WC—Co thermal sprayed coating.

8. A manufacturing method of a corrugating roll according to claim 1, wherein the local heating quenching and tempering treatment includes induction hardening, laser hardening, or flame hardening.

9. A manufacturing method of a corrugating roll according to claim 8, wherein the wear resistant coating is a hard chromium plating, a SiC dispersed Ni—P plating, a TiN coating, a TiC coating, a cBN coating, a diamond coating, a carbon coating, a diamond electroposited coating or a WC—Co thermal sprayed coating.

10. A manufacturing method of a corrugating roll according to claim 1 to claim 5, wherein the wear resistant coating is a hard chromium plating, a SiC dispersed Ni—P plating, a TiN coating, a TiC coating, a cBN coating, a diamond coating, a carbon coating, a diamond electrodeposited coating or a WC—Co thermal sprayed coating.

11. A manufacturing method of a corrugating roll according to claim 1, wherein in said step b), said high hardness outer layer is formed only at tip portions of the tooth-shaped corrugation portions.

12. A manufacturing method of a corrugating roll comprising tooth-shaped corrugation portions on an outer circumference of the corrugating roll, comprising applying to a base metal of the corrugation portions of the corrugating roll by a nitriding treatment or a carbo-nitriding treatment and then applying a quench hardening treatment, and forming a high hardness outer layer of a thickness of 0.6 mm or more and of a Shore hardness (Hs) of 80 or more along a profile of the corrugation tip portion or the corrugation portion.

13. A manufacturing method of a corrugating roll according to claim 12, including forming a wear resistant coating along the profile of the corrugation portion.

* * * * *